United States Patent [19]

Jacobs

[11] 4,421,460

[45] * Dec. 20, 1983

[54] METHOD OF OPERATING A MOTOR COMPRESSOR UNIT

[75] Inventor: John J. Jacobs, Pulaski, N.Y.

[73] Assignee: Carrier Corporation, Syracuse, N.Y.

[ * ] Notice: The portion of the term of this patent subsequent to Aug. 4, 1998 has been disclaimed.

[21] Appl. No.: 230,571

[22] Filed: Feb. 2, 1981

Related U.S. Application Data

[62] Division of Ser. No. 7,868, Jan. 31, 1979, Pat. No. 4,281,972.

[51] Int. Cl.[3] ..... F04B 35/04

[52] U.S. Cl. ..... 417/53; 417/415

[58] Field of Search ..... 417/415, 902, 53, 271, 417/273

[56] References Cited

U.S. PATENT DOCUMENTS 2,138,093 11/1938 Feldbush et al. ..... 417/271
2,153,773 4/1939 Patrignani ..... 417/902 X
3,239,132 3/1966 Frank et al. ..... 417/363
4,281,972 8/1981 Jacobs ..... 417/415

*Primary Examiner*—Richard E. Gluck
*Attorney, Agent, or Firm*—Donald F. Daley; Frank N. Decker, Jr.

[57] ABSTRACT

A hermetically sealed motor compressor unit has refrigerant gas at discharge pressure substantially surrounding the motor of the unit. The compressor includes at least two cylinders in which gas is compressed. A suction plenum for receiving gas at suction pressure surrounds each of the cylinders. Conduits, equal in number to the number of cylinders, are disposed externally of the compressor for delivering the gas into each of the plenums. One end of the conduit is connected to the plenum and the other end of each conduit is interconnected with the remaining conduits. The pressure pulsations developed in each conduit are controlled whereby the pressure in each plenum is at a maximum when the suction valve for a particular cylinder opens and is at a minimum when the piston is substantially at bottom dead center.

1 Claim, 2 Drawing Figures

METHOD OF OPERATING A MOTOR COMPRESSOR UNIT

BACKGROUND OF THE INVENTION

This application is a division of application Ser. No. 007,868, filed Jan. 31, 1979, now U.S. Pat. No. 4,281,972.

This invention relates to a hermetically sealed motor compressor unit of the type having refrigerant gas at discharge pressure substantially surrounding the motor of the unit, and in particular, relates to apparatus and method for controlling the performance characteristics of the compressor.

It has been found that the energy efficiency of a motor compressor unit can be significantly increased by filling the chamber in which the motor compressor unit is mounted with refrigerant gas at discharge pressure. Heretofore, it has been the practice to fill the chamber with gas at suction pressure, with the gas cooling the motor's windings prior to entry into the compressor's cylinders. In the present arrangement, the suction gas is not used for motor cooling, but rather is led to a relatively small chamber or plenum in direct flow communication with the compressor's cylinder. The temperature of the gas is thus maintained at a minimum prior to compression.

In addition to the foregoing, it has also been recognized that improvements in the energy efficiency of a compressor may be obtained by insuring that the suction valve closes and is prevented from opening when the piston in a cylinder is compressing gas therein to avoid any backflow of gas from the cylinder to the suction plenum. It is further desirable for improving efficiency to insure that the pressure in a suction plenum is at a maximum when the suction valve opens to cause a maximum flow of gas into the cylinder for compression.

Since, in a hermetically sealed compressor having discharge gas surrounding the motor, the suction gas, of necessity, is led directly into the suction plenums surrounding the cylinders of the compressor, it has been found advantageous to interconnect the various conduits delivering refrigerant gas to each suction plenum to achieve optimum control of the opening and closing of each cylinder's suction valve. In addition to interconnecting the suction conduits to control the compressor's performance, it has been found that compressor performance will be effected by the volume of the suction plenum and by the length and diameter of the interconnected conduits. In fact, it has been found that the particular length of the conduits should be varied in accordance with design changes in the volume of the suction plenum and/or diameter of the conduits for obtaining desired performance characteristics for the compressor.

In automotive engines, it is known that improved performance may be obtained by providing discharge lines of varying length from the cylinders to rapidly achieve a maximum flow of discharge gas from the engine. It is also known in the automotive engine art to vary the length of suction lines for supercharging air into the engine's cylinders. However, as is readily recognized, automotive engines use mechanical valve lifters for controlling the movement of the suction and discharge valves. No similar devices are employed in hermetically sealed compressors wherein it has been found that pressure pulsations within interconnected conduits communicating the various suction plenums of the compressor can be controlled and used to achieve desired performance characteristics for the compressor.

SUMMARY OF THE INVENTION

It is accordingly an object of this invention to control the performance of a hermetically sealed motor compressor unit having refrigerant gas at discharge pressure substantially surrounding the motor of the unit.

It is a further object of this invention to control the performance of a hermetically sealed motor compressor unit of the type described by optimizing the lengths of interconnected suction conduits.

It is yet another object of this invention to utilize pressure pulsations within interconnected conduits for opening and closing a suction valve for achieving optimum compressor performance.

These and other objects of the present invention are attained in a hermetically sealed motor compressor unit having refrigerant gas at discharge pressure substantially surrounding the motor of the unit. The compressor includes at least two cylinders in which the gas is compressed. A suction plenum for receiving gas at suction pressure surrounds each of the cylinders. Conduits, equal in number to the number of cylinders, are disposed externally of the compressor for delivering the gas into each of the plenums. One end of the conduit is connected to the plenum and the other end of each conduit is interconnected with the remaining conduits. The pressure pulsations developed in each conduit are controlled whereby the pressure in each plenum is at a maximum when the suction valve for a particular cylinder opens and is at a minimum when the piston is substantially at bottom dead center. The cylinder is filled with a maximum quantity of gas when the piston is at bottom dead center.

DESCRIPTION OF THE PREFERRED EMBODIMENT

Figure 2:
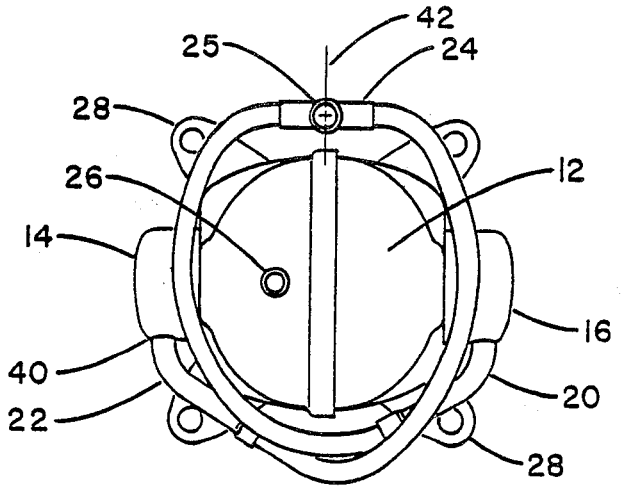
FIG. 2 is a top plan view of the motor compressor unit illustrated in FIG. 1.

Referring now to the drawing, there is disclosed a preferred embodiment of the present invention. In referring to the two figures of the drawing, like numerals shall refer to like parts.

Figure 1:
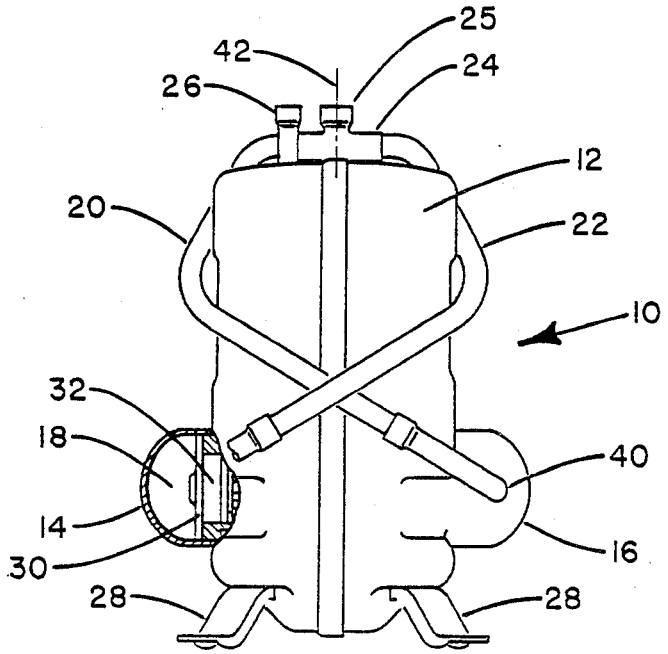
FIG. 1 is a frontal plan view of a hermetically sealed motor compressor unit embodying the present invention.

A hermetically sealed motor compressor unit, generally designated 10, having a hermetically sealed shell 12, includes cylinder covers 14 and 16 surrounding the two cylinders of the compressor. As shown covers 14 and 16 are formed integral with shell 12; however the covers may also be formed separate from the shell and attached thereto by conventional fastening means. For the purpose of this invention compressor 10 must have at least two cylinders, however it should be understood that additional cylinders may be provided within the scope of the invention as described herein. Each cylinder head defines a suction plenum 18, shown in FIG. 1. Conduits 20 and 22 are provided to deliver refrigerant gas at suction pressure into each plenum 18.

Each suction conduit 20 and 22 is connected at one end to a plenum 18 and at the other end to an inverted T-shaped connecting member 24. Inlet 25 of connecting member 24 is suitably connected to a refrigeration unit evaporator (not shown) of a type well known to those skilled in the art. Suction gas from the evaporator will flow through inlet 25 and connecting member 24 and thence through conduits 20 and 22 to the cylinders of the compressor. Member 24 functions to interconnect conduits 20 and 22 for a reason to be more fully explained hereinafter. The refrigerant gas delivered into each suction plenum 18 passes through suction valves 30 into the cylinders for compression by operation of pistons 32 in a manner well known to those skilled in the art.

Support feet 28 are attached to cylinder shell 12 and provide means for mounting compressor 10 on a horizontal base. The compressor further includes discharge line 26 which delivers compressed gas from the compressor to a refrigeration condenser of a type well known to those skilled in the art.

The reciprocating movement of pistons 32 in each of the cylinders causes pressure pulsations within interconnected conduits 20 and 22 and within each suction plenum 18 of the compressor. In effect, the suction plenums of each cylinder and the interconnecting conduits form a closed dynamic system. The pressure pulsations generated through movement of the pistons, will continuously move through the closed dynamic system. The pressure pulsations within a particular plenum 18 can be controlled to effectively open and close the suction valve for each cylinder to achieve maximum compressor performance. The pressure pulsation within a particular suction plenum 18 should achieve a maximum magnitude just prior to the suction valve opening to force a maximum quantity of gas into the cylinder upon the actual opening of the suction valve. In effect, the cylinder will become supercharged with refrigerant gas. Similarly, the pressure of the pulsation should be at a minimum magnitude within a particular suction plenum 18 when piston 32 is at bottom dead center to insure that the suction valve will be closed to prevent reversal of flow of gas from the cylinder into the suction plenum. Heretofore, it has been found that, by permitting uncontrolled pressure pulsations within the suction plenums, a reversal of flow from the cylinder into the plenum may occur since the suction valve may not necessarily remain seated or closed even though the refrigerant gas has entirely filled the cylinder. In effect, an uncontrolled pressure pulsation within a plenum can suddenly cause the suction valve to inopportunely open to permit a reversal of flow of gas from the relatively high pressure cylinder into the low pressure plenum. As is obvious, the foregoing is very undesirable and will reduce total compressor performance.

To achieve maximum compressor performance, the pressure pulsations developed in each plenum surrounding each compressor cylinder should be controlled and utilized to open and close the suction valves at the most desirable point in the compression cycle. In effect, the pressure pulsation appearing in a particular plenum should be controlled to be at a minimum or maximum value at the point in the compressor cycle when it would be most advantageous. To achieve the foregoing, it has been found that the volume of the suction plenum, the diameter of the suction conduits and the length of the suction conduits must be matched, with the length of each of the suction conduits being equal.

For example, in order to achieve desired energy efficiency, it has been found that the lengths of suction conduits 20 and 22 should generally be within the range of 20 to 50 inches for two through five ton units. The volume of each suction plenum generally is 2.3 times the swept volume of the cylinder. Additionally, ⅜ inch O.D. tubing is preferably utilized in manufacturing conduits 20 and 22.

It has been found that the energy efficiency of the compressor when the specific volume of the suction plenum, the diameter of the tubing and the length of the conduits are matched will follow the following formula: EER (Energy Efficiency Rating) $=8.07+1.05L-0.00175L^2$ wherein L is the total axial length in inches of the suction conduit measured from the point at which it enters the suction plenum, as represented by reference numeral 40, to the point at which it contacts connecting member 24 as represented by reference numeral 42.

In effect, the above described arrangement provides a relatively inexpensive tuning technique for achieving optimum compressor performance without introducing any significant manufacturing or reliability problems.

While a preferred embodiment of the present invention has been described and illustrated, the invention should not be limited thereto or may be otherwise embodied within the scope of the following claims.

What is claimed is:

1. A method of compressing gas in a motor compressor unit enclosed within a hermetically sealed shell and having a plurality of compression cylinders with a reciprocating piston located within each compression cylinder and a corresponding plurality of suction plenums, which comprises the steps of:

passing suction vapor exteriorly of the compressor shell from a common source of suction vapor to the plurality of suction plenums through a corresponding number of equal length suction vapor conduits extending from the common source of the suction vapor to the suction plenums;

periodically pulsing the pressure in the suction plenums and the equal length vapor conduits by reciprocating the pistons within the cylinders, to attain a minimum pressure in said suction plenums when the pistons are substantially at bottom dead center;

periodically discharging the compressed vapor from the compression cylinders into the interior of the shell of the compressor unit; and supercharging the cylinders with suction gas by periodically admitting suction vapor from the suction plenums into the compression cylinders of the compressor, substantially at the time of a maximum pressure pulse in the suction plenums.

* * * * *